United States Patent [19]

Potvin

[11] 4,003,967

[45] Jan. 18, 1977

[54] ELECTRIC HEATING AND HUMIDIFYING APPARATUS

[75] Inventor: Alfred Marcel Potvin, St. Lambert, Canada

[73] Assignee: Les Placement Courteau Limitee, Montreal, Canada

[22] Filed: Oct. 31, 1974

[21] Appl. No.: 519,696

[52] U.S. Cl. ..... 261/30; 219/272; 219/275; 219/276; 261/119 R; 261/142; 261/156; 261/157

[51] Int. Cl.[2] ..... B01F 3/04

[58] Field of Search ..... 261/30, 119 R, 129, 261/130, 141, 142, 153, 155, 156, DIG. 15, DIG. 65; 219/271–273, 275, 276

[56] References Cited

UNITED STATES PATENTS

| | | | |
|---|---|---|---|
| 1,981,916 | 11/1934 | Huntley | 219/276 X |
| 2,046,802 | 7/1936 | Van Vliet et al. | 261/30 X |
| 2,062,042 | 11/1936 | Sargent | 261/142 X |
| 2,759,713 | 8/1956 | Maniscalco, Sr. | 261/142 |
| 3,104,307 | 9/1963 | Garofalow et al. | 219/276 X |
| 3,219,795 | 11/1965 | Wiseman | 261/142 X |
| 3,323,784 | 6/1967 | Fazio | 261/142 X |
| 3,332,672 | 7/1967 | Schipper | 261/142 X |
| 3,348,828 | 10/1967 | Laing | 261/142 |
| 3,738,627 | 6/1973 | Scotchmur | 261/119 R |

*Primary Examiner*—Tim R. Miles
*Assistant Examiner*—Richard L. Chiesa
*Attorney, Agent, or Firm*—Diller, Brown, Ramik & Wight

[57] ABSTRACT

A space heating apparatus comprising a main enclosure having a front and a rear wall, side walls and a top and bottom wall. An air inlet opening is provided in the front wall with a filter removably secured therein. An impeller fan is mounted within the enclosure adjacent the opening for drawing outside air into the enclosure through the filter and convecting it through predetermined paths in the enclosure and out of the enclosure through vent openings provided therein. Heating elements are secured in the enclosure between the fan and the rear wall for heating the air. A water reservoir having a heater therein is provided in the enclosure. The water in the reservoir is heated to the boiling point whereby water vapor is mixed with the air convected through the predetermined paths. Control means are further provided for regulating the operation time cycle of the fan, heating elements and heater.

4 Claims, 4 Drawing Figures

FIG. 1
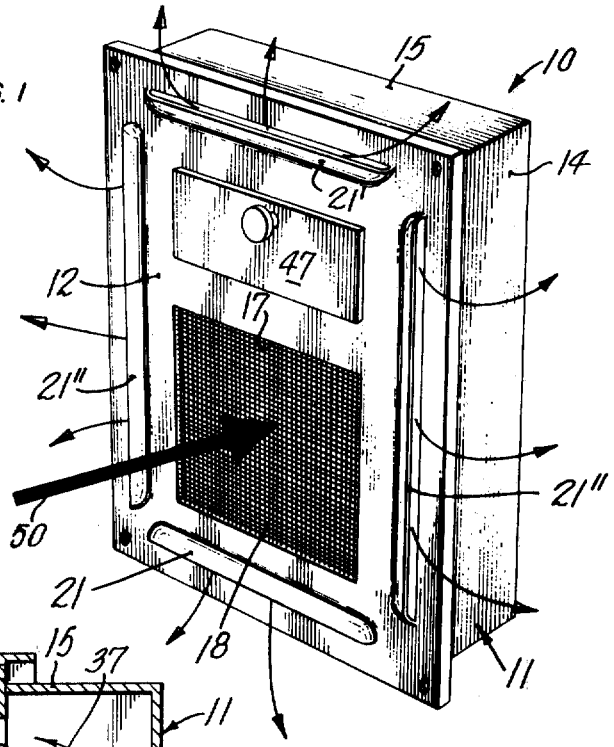
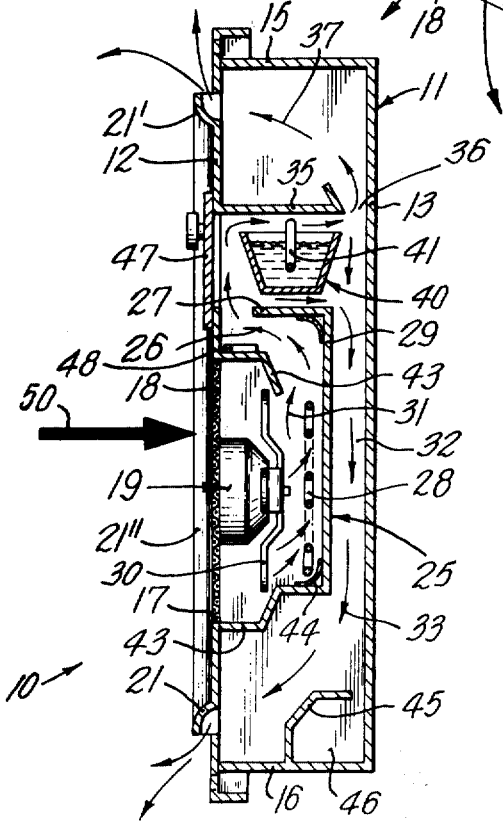
FIG. 2

ELECTRIC HEATING AND HUMIDIFYING APPARATUS

BACKGROUND OF INVENTION a. Field of the Invention

The present invention relates to heating apparatus, and more particularly, to an electric space heating apparatus for heating filtered air and humidifying it with water vapour.

b. Description of Prior Art.

Of the various types of electrical heating systems heretofore known, the majority of these consist primarily of a fan for drawing air adjacent the bottom of a heating apparatus and convecting it through heating coils where the air is heated and released from the top of the apparatus. Other types of apparatus are known wherein a fine water spray is ejected into the heated air whereby to provide humidity into the air. These types of apparatus have the disadvantage that impurities drawn into the apparatus are burned by the heating elements thus giving a bad odor to the air being convected out of the apparatus and causing dust to settle within the apparatus making it non-hygienic. Furthermore, the humidifying systems adapted to such apparatus are not very efficient and often causes the heating apparatus to corrode. Still further, a larger percentage of the convected heated air in such apparatus is released upwardly of the apparatus and does not quickly heat the lower area of a room where the cool air resides. Still further, some known prior art apparatus is very difficult to install and maintain and costly to fabricate.

SUMMARY OF INVENTION

It is a main feature of the present invention to provide an improved electrical space heating and humidifying apparatus which substantially overcomes all of the abovementioned disadvantages.

According to the above feature, from a broad aspect, the present invention provides a space heating apparatus comprising a main enclosure having a front and a rear wall, side walls and a top and bottom wall. An air inlet opening is provided in the front wall with a filter removably secured therein. An impeller fan is mounted within the enclosure adjacent the opening for drawing outside air into the enclosure through the filter and convecting it through predetermined paths in the enclosure and out of the enclosure through vent openings provided therein. Heating elements are secured in the enclosure between the fan and the rear wall for heating the air. A water reservoir having a heater therein is provided in the enclosure. The water in the reservoir is heated to the boiling point whereby water vapour is mixed with the air convected through the predetermined paths. Control means are further provided for regulating the operation time cycle of the fan, heating elements and heater.

BRIEF DESCRIPTION OF DRAWINGS

A preferred embodiment of the present invention will now be described with reference to the accompanying drawings in which:

FIG. 1 is a perspective view of the space heating apparatus;

FIG. 2 is a sectional side view of the space heating apparatus;

DESCRIPTION OF PREFERRED EMBODIMENTS

Figure 3:
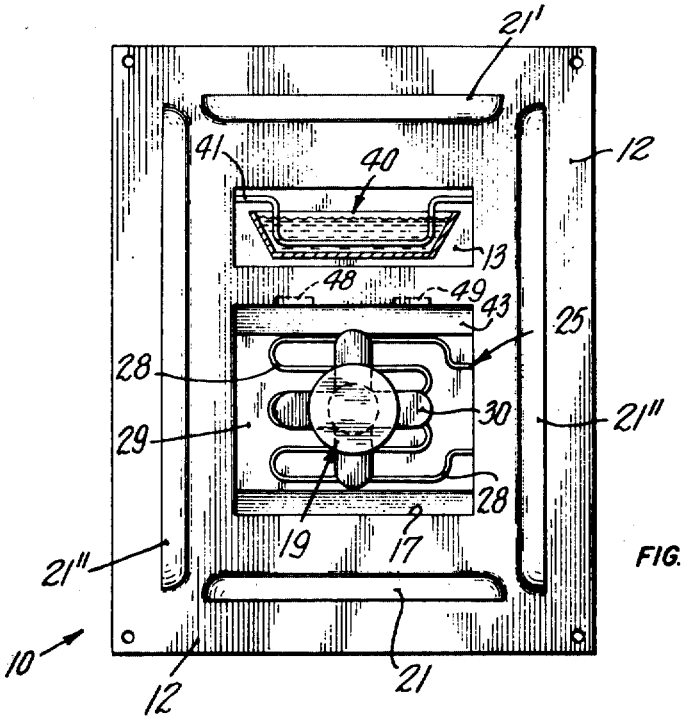
FIG. 3 is a front view of the apparatus with the filter and door to the water reservoir removed.

Referring now to the drawings, and more particularly to FIGS. 1, 2 and 3, there is shown generally at 10, the space heating apparatus of the present invention. The space heating apparatus comprises a main enclosure 11 having a front wall 12, a rear wall 13, side walls 14, and a top and bottom wall, 15 and 16 respectively. An air inlet opening 17 is formed in the front wall 12 and a filter 18 is removably secured within the opening 17. The filter may be of the charcoal-filled type or other suitable type to remove impurities from the air. An intermediate enclosure 25 is secured within the main enclosure 11 between the front and rear walls 12 and 13 of the main enclosure. The intermediate enclosure 25 is positioned about the opening 17 and an impeller fan 19 is secured within the intermediate enclosure 25 adjacent the opening 17 for drawing outside air into the enclosure, in a direction as illustrated by arrows 50, through the filter 18 and convecting the air through predetermined paths in the main enclosure 11. An opening 26 is provided in the top wall 27 of the intermediate enclosure 25 for releasing air which is drawn into the intermediate enclosure and which is heated by the heating elements 28 which are secured between a back wall 29 of the intermediate enclosure and the blades 30 of the fan 19. Thus, it can be seen that the air is convected through the heating elements and the hot air will be forced upwardly by the fan, in the direction of arrows 31, through the opening 26 in the top wall 27.

As is more clearly illustrated in FIG. 2, the back wall 29 of the intermediate enclosure is positioned substantially parallel to the rear wall 13 of the main enclosure 11 whereby to define a convection path for a downward flow of air, as shown by arrows 33, therethrough. The air flowing downwardly between the back wall 29 and the rear wall 13 is also heated by the back wall 29 which is positioned closely to the heating elements 28. This downward flow of hot air is pushed out of the main enclosure by the fan and released via a vent opening 21 adjacent the bottom of the main enclosure 11.

A horizontal intermediate wall 35 is secured a predetermined distance above the intermediate enclosure 25 and located between the front and rear walls, 12 and 13, of the main enclosure 11. An opening 36 is provided in the horizontal wall and adjacent the rear wall 13 of the main enclosure, to permit passage of some of the hot air released through the opening 26 in the top wall 27 of the intermediate enclosure 25. The opening 36 has a smaller orifice than the opening 26. The hot air passing through the orifice 36, as illustrated by arrows 37, is released through a vent opening 21' in the top portion of the main enclosure 11.

A water reservoir 40 having a heater 41 therein is provided for heating the water in the reservoir to the boiling point whereby water vapour is released from the reservoir 40 and mixed with the air convected out of the opening 26 of the intermediate enclosure 25. The operation time cycle of the heater 41 depends on the percentage humidity required in the air and is controlled by a humidistat which is normally mounted at a convenient location in an apartment or if the heating apparatus is of the portable type, it would normally be secured to the apparatus at a convenient location and insulated from the apparatus.

Figure 4:
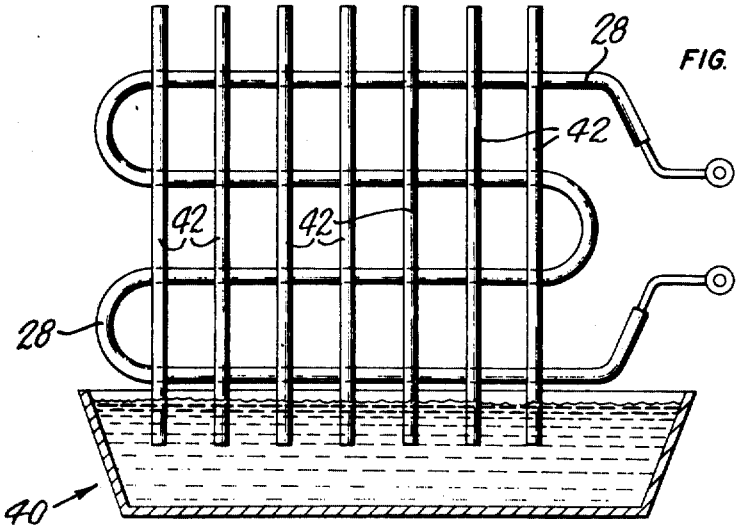
FIG. 4 illustrates a further embodiment of the humidifier.

Referring to FIG. 4, there is shown a further embodiment of the water reservoir 40. In this embodiment, the water reservoir 40 is located below the heating elements 28 and the fan 19. For this type application, water vapour is constantly released in the air when the air is being heated by the elements 28 as part of the heating fins 42, which are secured to the heating elements 28 and also conduct heat, provide the heater for the water reservoir. The fins 42 also provide a larger surface area of heating elements through which air is convected and heated. Alternatively, the heating elements 28 may have a different shape and part of the element may extend through the reservoir 40, although this is not shown in the drawing. In this application, the fins 42 would not be required. Although not shown, the water level in the reservoir 40 is controlled by a float (not shown) which is commonly known in the art and which is associated with an inlet valve causing air to flow into the reservoir when the level reaches a predetermined limit. Further, although not shown, when the heating apparatus is of the portable type, a water tank may be provided in the upward region of the apparatus to supply the reservoir 40.

Referring again to FIGS. 1 to 3, it can be shown that further intermediate deflection walls are provided whereby to provide substantially unobstructed convection paths. As shown in FIG. 2, a deflector wall 43 is provided about the fan whereby substantially all of the incoming air drawn into the apparatus is convected through the heating elements and out the opening 26 in the top wall of the intermediate enclosure 25. This air then passes about the water reservoir 40 where it mixes with water vapour and part of this air mixture will move upwardly through the opening 36 and part downwardly through the convection path 32 and to each side of the intermediate enclosure 25 whereby hot air may also be released through vent openings 21'' on each side of the front wall 12. Arcuate intermediate walls 44 may also be secured in the right angle corners of the intermediate enclosure to provide smooth flow of air. The wall 45 in the lower corner adjacent the rear wall 13 and bottom wall 16 of the main enclosure provides a compartment 46 for entry and connection of the wiring for the apparatus. A door 47 is also provided in the front wall 12 of the main enclosure for access to the water reservoir 40.

As shown in FIG. 3, a fan limit switch 48 and a limit control cut-off switch 49 are conveniently located inside the main enclosure, herein shown on a wall of the intermediate enclosure 25. Further, the intermediate enclosure 25 is removably secured in the main enclosure 11 whereby, for maintenance purposes, the fan and heating elements may be easily removed without removing the main enclosure from the wall to which it is normally installed in. This would not be necessary with the portable version of the heating apparatus as the top wall of the apparatus may be provided with hinges for access to a water supply tank.

The operation of the apparatus will now be described. For heating purposes, the apparatus is started by setting the thermostat (not shown) to the desired room temperature. If the room temperature is below that set on the thermostat, this will switch the heating elements on until the temperature in the main enclosure in the vicinity of the fan limit switch reaches 100° F. When the temperature inside the unit reaches 100° F. the fan 19 will start. When the temperature in the environment of the thermostat reaches the required temperature, the electric currents to the heating elements is cut off and the fan 19 continues to operate until the temperature in the environment of the fan limit switch 48 reaches 100° F., at this point the fan is stopped automatically.

The humidifier which is constituted by the water reservoir 40 and heater 41 may be controlled independently of the heating elements 28 when it is required to humidify the air but not heat it. The humidifier is operated by a humidistat (not shown). When humidity is required, the humidistat is switched on and the desired percentage humidity set. This will connect current to the heater 41. When the water in the reservoir 40 reaches 212° F. (the boiling point), water vapour will be released from the reservoir. At that time, the fan is operating and the water vapours are mixed with the air being convected about the water reservoir. Thus, the apparatus provides filtered air mixed with purified vapour thus releasing a very clean hygienic mixture of air and humidity. When the humidity has reached its required level, the heater 41 is cut-off and the fan continues to operate as previously described whereby to remove all water vapour from the inside of the main enclosure 11. The limit control cut-off switch 49 is provided for safety precaution and will cut off all electrical current to the fan, heating elements, and heater in the event the temperature inside the apparatus reaches 200° F.

In the particular embodiment illustrated in FIGS. 1 to 3, there is at least three times as much air convected downwardly in the main enclosure than that directed upwardly and out through the vent 21'. The purpose for this is to maintain a release of hot air downwardly into a room where the apparatus is located. FIG. 1 illustrates the direction of air flow being released by the apparatus with the air being sucked in directly in front of the filter 18. Thus, the cool air in the room will quickly be displaced by the hot air being released, under pressure by the fan, primarily downwardly from the unit.

Other advantages of the present apparatus are that the air being released is filtered and humidified with water vapour. Also, each unit is independently controlled and individual ones of the units in a system can be operated independently at any time of the year. Also, the apparatus is very compact, that shown in FIG. 2 being 15 inches × 15 inches and very narrow, and can be located anywhere in an apartment. The apparatus is also economical to construct, easy to repair and safe to utilize. The installation costs of such apparatus is also very economical and the unit does not require frequent cleaning as is the case with some prior art apparatus.

I claim:

1. A space heating apparatus comprising a main enclosure having a front and a rear wall, side walls and a top and bottom wall; an air inlet opening in said front wall, a filter in said opening, an impeller fan mounted within said enclosure adjacent said opening for drawing outside air into said enclosure through said filter and convecting it through predetermined paths in said enclosure and out of said enclosure through vent openings provided therein, and intermediate enclosure secured between said front and rear walls and having a back wall spaced from said main enclosure rear wall to permit passage of convected air in a space between said back wall and rear wall, said intermediate enclosure being positioned about said opening in said front wall whereby said impeller fan is located within said intermediate enclosure, heating elements secured in said intermediate enclosure between said fan and said back wall for heating said air, an opening in a top wall of said intermediate enclosure for release of air drawn and heated in said intermediate enclosure, said back wall being heated by said heating elements to further heat convected air passing between said back wall and rear wall, a water reservoir having a heater therein for heating water in said reservoir to the boiling point whereby water vapour is mixed with the air convected through said predetermined paths, a horizontal intermediate wall secured a predetermined distance above said intermediate enclosure and said water reservoir and located between said front and rear wall of said main enclosure, and an opening in said horizontal intermediate wall to permit passage of some of said convected air therethrough and out through said vent opening above said intermediate enclosure, said opening in said intermediate enclosure being located adjacent said main enclosure front wall, and said opening in said horizontal intermediate wall being located adjacent said main enclosure rear wall, and control means for regulating the operation time cycle of said fan, heating elements and heater, there being at least three times as much air directed downwardly than that directed upwardly in said housing.

2. A space heating apparatus as claimed in claim 1 wherein said intermediate enclosure is spaced from said main enclosure rear wall, top wall and bottom wall and wherein vent openings are located in said front wall of said main enclosure at least above and below said intermediate enclosure.

3. A space heating apparatus as claimed in claim 1 wherein said air drawn into said intermediate enclosure is firstly heated by said heating elements and convected upwardly through said opening in said top wall of said intermediate enclosure and about said water reservoir and then partly upwards through said opening in said intermediate horizontal wall and partly downwards through said space defined between said main enclosure rear wall and said intermediate enclosure rear wall.

4. A space heating apparatus as claimed in claim 1 wherein said control means is a thermostat and a humidistat, said thermostat controlling electric current to said heating elements, temperature responsive switch means for controlling electric current to said fan, said fan being operated to start when the temperature in said main enclosure reaches a first predetermined temperature, said fan being cut off when a predetermined environmental temperature is reached and when said temperature in said main enclosure again reaches said first predetermined temperature and said current to said heating element and to said heater in said water reservoir is cut off, there further being provided temperature sensing switch means to cut off electric power to said apparatus when temperature inside said apparatus reaches a further predetermined temperature.

* * * * *